US005775960A

United States Patent [19]

Saito et al.

[11] Patent Number: 5,775,960

[45] Date of Patent: Jul. 7, 1998

[54] FEMALE TERMINAL

[75] Inventors: Hitoshi Saito; Hisashi Tsukamoto, both of Shizuoka, Japan

[73] Assignee: Yazaki Corporation, Tokyo, Japan

[21] Appl. No.: 774,271

[22] Filed: Dec. 27, 1996

[30] Foreign Application Priority Data

Dec. 28, 1995 [JP] Japan ..... 7-343970

[51] Int. Cl.[6] ..... H01R 13/187

[52] U.S. Cl. ..... 439/843; 439/851

[58] Field of Search ..... 439/843, 842, 439/844, 851, 852, 856, 857

[56] References Cited

U.S. PATENT DOCUMENTS 5,186,663 2/1993 Wymelenberg ..... 439/843
5,199,910 4/1993 Kahle et al. ..... 439/843
5,419,723 5/1995 Villiers et al. ..... 439/843
5,516,310 5/1996 Sawada ..... 439/843

FOREIGN PATENT DOCUMENTS 547969 6/1993 European Pat. Off. ..... 439/842

*Primary Examiner*—P. Austin Bradley
*Assistant Examiner*—Tho Dac Ta
*Attorney, Agent, or Firm*—Armstrong, Westerman, Hattori, McLeland & Naughton

[57] ABSTRACT

A female terminal is described which comprises a main body with a pair of opposed elastic clamping portions and a cylindrical sleeve which is inserted onto the main body. Inclined surfaces are provided in the opposite edges of each of the free ends of the elastic clamping portions so that the opposite edges do not abut the inner wall of the sleeve, when a male terminal is inserted into the female terminal.

6 Claims, 4 Drawing Sheets

FEMALE TERMINAL

FIELD OF THE INVENTION

The present invention relates to an improvement in the female terminal that is primarily used in the electric wiring for automobiles and the like.

DESCRIPTION OF THE RELATED ART

A conventional sleeve-attached female terminal is shown in FIG. 8 by way of example and it has a structure where the outside of a main body (b) with a pair of elastic clamping portions (a) and (a') is protected by a cylindrical sleeve (c). The elastic clamping portions (a) and (a') are formed so that the spacing therebetween becomes narrower as it goes toward the free ends thereof, for the purpose of clamping an opposite male terminal which is inserted into the female terminal. The free ends of the elastic clamping portions (a) and (a') are bent outwardly to form guiding portions (d) and (d') so that the male terminal can be readily received.

The outer peripheral walls of the guiding portions (d) and (d') are formed into circular arc shapes so that they can be expanded and clamp a male terminal when the male terminal is inserted into the female terminal.

With the complexity and high-density of electric circuits, miniaturization of terminals has recently been demanded. Extra fine cooperating male terminals have also become used, and there has occurred the necessity of a reduction in the inner diameter of the sleeve (c), a reinforcement in the clamping force for a cooperating male terminal, and an enlargement in the guiding portions (d) and (d') for facilitating insertion of the male terminal.

If the radius of curvature R of the outer peripheral walls of the guiding portions (d) and (d') is set so that it becomes larger than the inner radius (r) of the sleeve (c) in order to make the guiding portions as large as possible, the guiding portions (d) and (d') will be expanded outwardly by the male terminal (e) when the male terminal is inserted, as shown in FIGS. 9 and 10. However, there are cases where the opposite edges (d1) of the guiding portion (d or d') or the edges (a1 and a1') (see FIG. 8) of the proximal portions of the elastic clamping portions (a and a') abut the inner wall (f) of the sleeve (c).

If the edge (d1 or d1') of the guiding portion (d or d') or the edge (a1 or a1') of the proximal portion of the elastic clamping portion (a or a') abuts the inner wall (f) of the sleeve (c), the expanding of the guiding portion and the elastic clamping portion will then be prevented by the inner wall (f) of the sleeve (c), and consequently the force needed for inserting the male terminal, that is, the terminal insertion force will become very high and the inserting operation of the male terminal will become difficult.

For the aforementioned reason, there is the need for forming space beforehand so that the guiding portions (d and d') and the elastic clamping portions (a and a') are not brought into contact with the inner wall of the sleeve (c), and there is the disadvantage that an increase in the size of the sleeve (c) cannot be avoided.

Particularly, in order to enhance the clamping force without varying the lengths of the elastic clamping portions (a and a'), the widths of the elastic clamping portions (a and a') have to be enlarged. Since the diameter of the sleeve (c) is also increased and the size of the entire terminal is increased, there is the problem that an enhancement in wiring density and a reduction in the weight cannot be achieved.

SUMMARY OF THE INVENTION

The present invention has been made in view of the aforementioned problems.

Accordingly, it is an objective of the present invention to provide a female terminal where the clamping force of an elastic clamping portion can be strengthened without increasing the inserting force of a male terminal.

Another objective of the present invention is to provide a female terminal where insertion of a male terminal is easy and where miniaturization and a reduction in the weight can be achieved.

Still another objective of the present invention is to provide a female terminal which is capable of contributing to an enhancement in wiring density.

The foregoing objectives are accomplished by providing a female terminal which comprises: a main body with a pair of opposed elastic clamping portions; a cylindrical sleeve which is installed onto the main body; and inclined surfaces provided in the opposite edges of each of the free or leading ends of the elastic clamping portions.

In a preferred form of the invention, the outer peripheral walls of the guiding portions of the pair of opposed elastic clamping portions are formed into circular arc shapes and each of the outer peripheral walls has a radius of curvature larger than the inner radius of the sleeve.

In another preferred form of the invention, inclined surfaces are provided on the front end portions of the opposite edges of each of the guiding portions of the elastic clamping portions.

The foregoing objectives are also accomplished by providing a female terminal which comprises: a main body with a pair of opposed elastic clamping portions; a cylindrical sleeve which is installed onto the main body; and inclined surfaces provided in the overall opposite edges of each of the elastic clamping portions.

In a preferred form of the invention, the outer peripheral walls of the pair of opposed elastic clamping portions are formed into circular arc shapes and each of the outer peripheral walls has a radius of curvature larger than the inner radius of the sleeve.

BRIEF DESCRIPTION OF THE DRAWINGS

The present invention will be described in further detail with reference to the accompanying drawings, in which.

DETAILED DESCRIPTION OF THE PREFERRED EMBODIMENTS

Preferred embodiments of the present invention will hereinafter be described in reference to the drawings.

Figure 1:
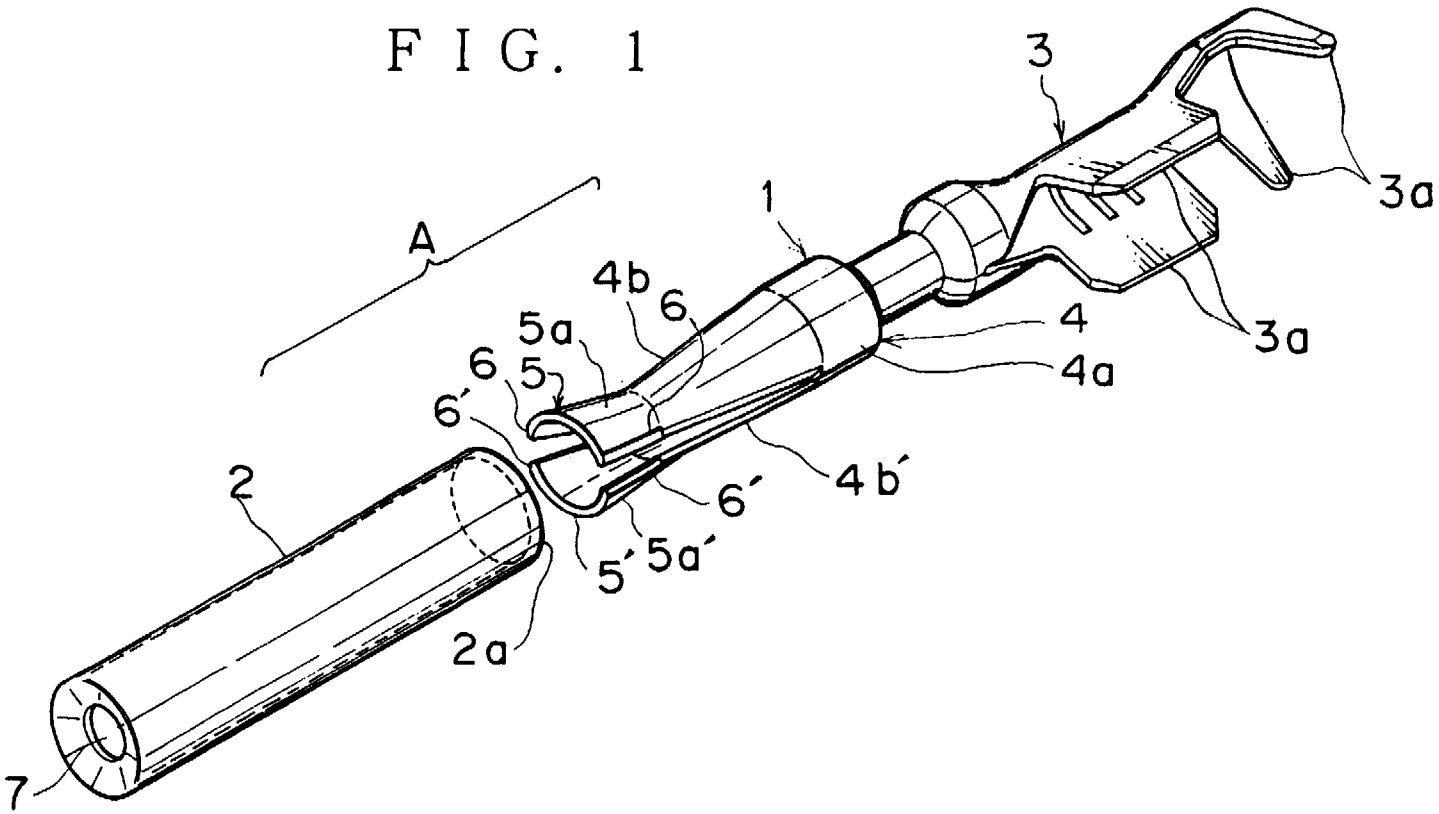
FIG. 1 is an exploded perspective view showing a female terminal according to an embodiment of the present invention.

Referring to FIG. 1, there is shown a female terminal A constructed in accordance with an embodiment of the present invention.

The female terminal A comprises a main body 1 and a sleeve 2 which the main 1 is inserted.

The main body 1 of the terminal is formed from a conductive metal plate by a bending process. The main body 1 is equipped with an electric-wire connecting portion 3 with opposed caulking portions 3*a* and also is equipped with an electric contact portion 4 for clamping an opposite male terminal (not shown) which is inserted into the female terminal A. The electric contact portion 4 is provided with a cylindrical proximal portion 4*a* and a pair of opposed elastic clamping portions 4*b* and 4*b*' extending forward from the cylindrical proximal portion 4*a*.

The elastic clamping portions 4*b* and 4*b*' have outer peripheral walls curved into circular arc shapes in the same way as the proximal portion 4*a* and are formed so that the spacing therebetween becomes narrower as it goes toward the free ends thereof. The free ends of the elastic clamping portions 4*b* and 4*b*' are bent outwardly to form guiding portions 5 and 5' so that a cooperating male terminal can be readily received.

The guiding portions 5 and 5' also have outer peripheral walls 5*a* and 5*a*40 curved into circular arc shapes, and the radius of curvature R is formed so as to become larger than the inner radius (r) of the sleeve 2.

Figure 2:
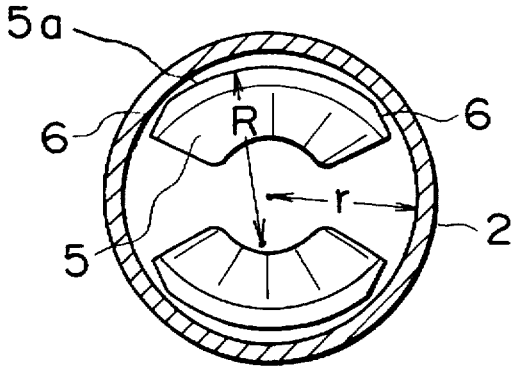
FIG. 2 is an end view used to explain the inclined surface portions formed in the expanded portions of the elastic clamping portions of FIG. 1.

As shown in FIG. 2, inclined surfaces 6 are formed on the opposite edges of the outer peripheral wall 5*a* of the upper guiding portion 5 by cutting off the corners of the opposite edges, respectively. Likewise, inclined surfaces 6' are similarly formed on the opposite edges of the outer peripheral wall 5*a*40 of the lower guiding portion 5'.

The sleeve 2 is formed from a conductive metal plate into a cylindrical shape by a bending process. The sleeve 2 has a terminal inserting hole 7 at its front end and is formed at its rear end with an opening 2*a* through which the sleeve 2 is inserted onto the proximal portion 3 of the main body 1 of the terminal.

Figure 4:
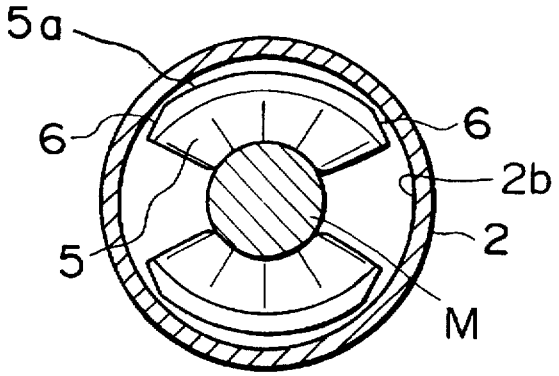
FIG. 4 is an end view used to explain the expanded portions of the elastic clamping portions of FIG. 3.
Figure 3:
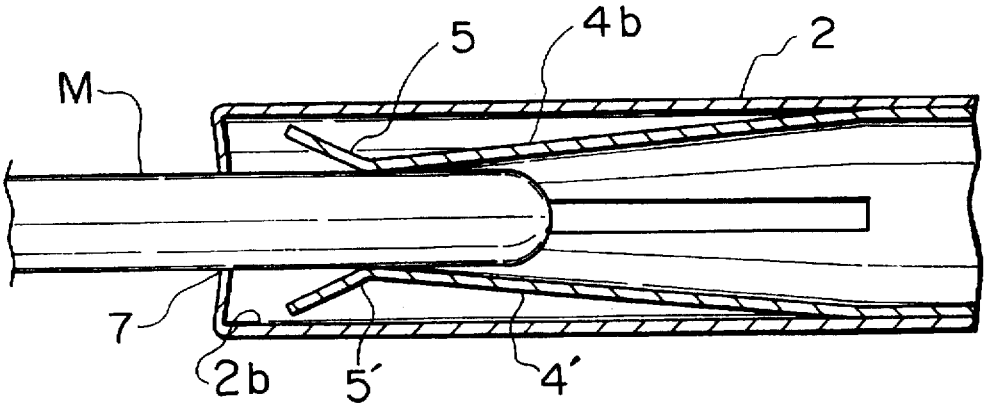
FIG. 3 is a longitudinal sectional view showing a male terminal inserted in the female terminal of FIG. 1.

FIG. 3 shows an opposite male terminal M inserted in the female terminal. Insertion of the male terminal M causes the guiding portions 5 and 5' to expand from each other. In this case, since the aforementioned inclined surfaces 6 and 6' are formed on the opposite edges of the guiding portions 5 and 5', there is no possibility that the outer peripheral walls 5*a* and 5*a*40 of the guiding portions 5 and 5' interfere with the inner wall 2*b* of the sleeve 2, as shown in FIG. 4. Therefore, an excessive inserting force is not needed for inserting the male terminal M and the mutual insertion operation for the male and female terminals can be performed easily and smoothly.

Figure 5:
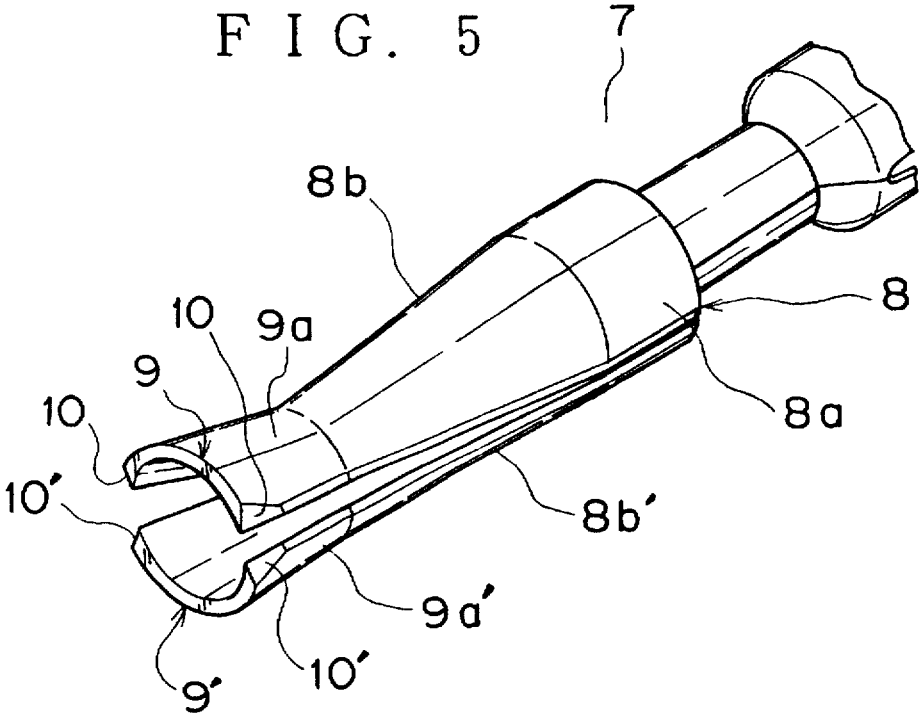
FIG. 5 is a perspective view showing the essential part of a female terminal according to another embodiment of the present invention.

FIG. 5 illustrates the essential part of the main body 7 of a female terminal constructed in accordance with another embodiment of the present invention. The electric contact portion 8 of the main body 7, as with the main body 1 of the aforementioned embodiment, is equipped with a proximal portion 8*a* and a pair of elastic clamping portions 8*b* and 8*b*' extending forward from the proximal portion 8*a*, and guiding potions 9 and 9' curved into circular arc shapes are formed on the free ends of the elastic clamping portions 8*b* and 8*b*' so that they are expanded outside.

Inclined surfaces 10 are formed on the front end portions of the opposite edges of the outer peripheral wall 9*a* of the upper guiding portion 9, respectively. Similarly, inclined surfaces 10' are formed on the front end portions of the opposite edges of the outer peripheral wall 9*a*' of the lower guiding portion 9', respectively. When the opposite male terminal is inserted into the sleeve 2 of the female terminal, the guiding portions 9 and 9' are further expanded and the portions which first abut the inner wall 2*b* of the sleeve 2 are the front end portions of the opposite edges of each of the outer peripheral walls 9 and 9*a* of the guiding portions 9 and 9', and consequently, it is particularly effective to provide the inclined surfaces 10 and 10' on the aforementioned front end portions.

Figures 6, 7:
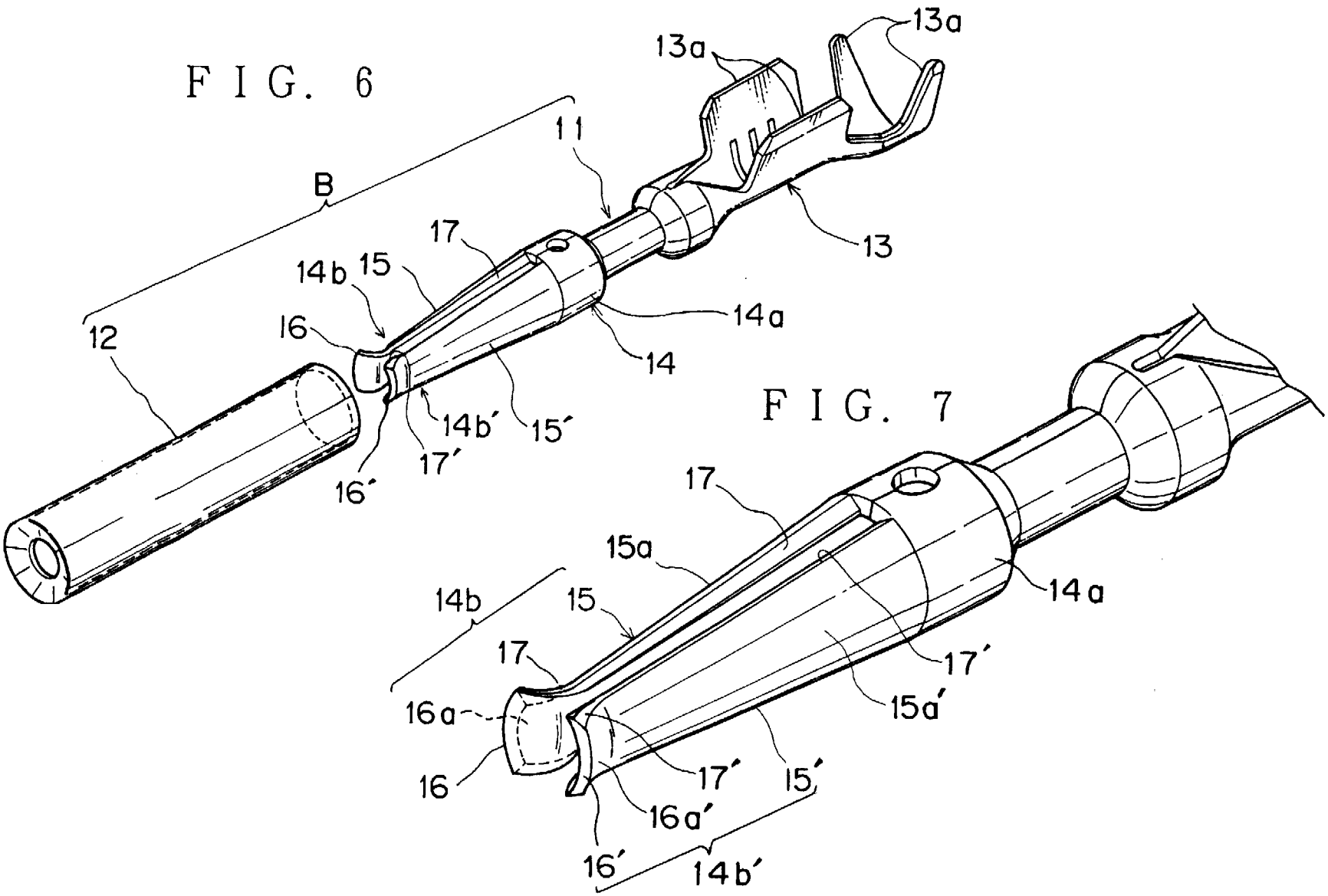
FIG. 6 is an exploded perspective view showing a female terminal according to still another embodiment of the present invention.
FIG. 7 is a perspective view showing the inclined surface portions formed on the edges of the elastic clamping portions of FIG. 6.
Figures 8, 9, 10:
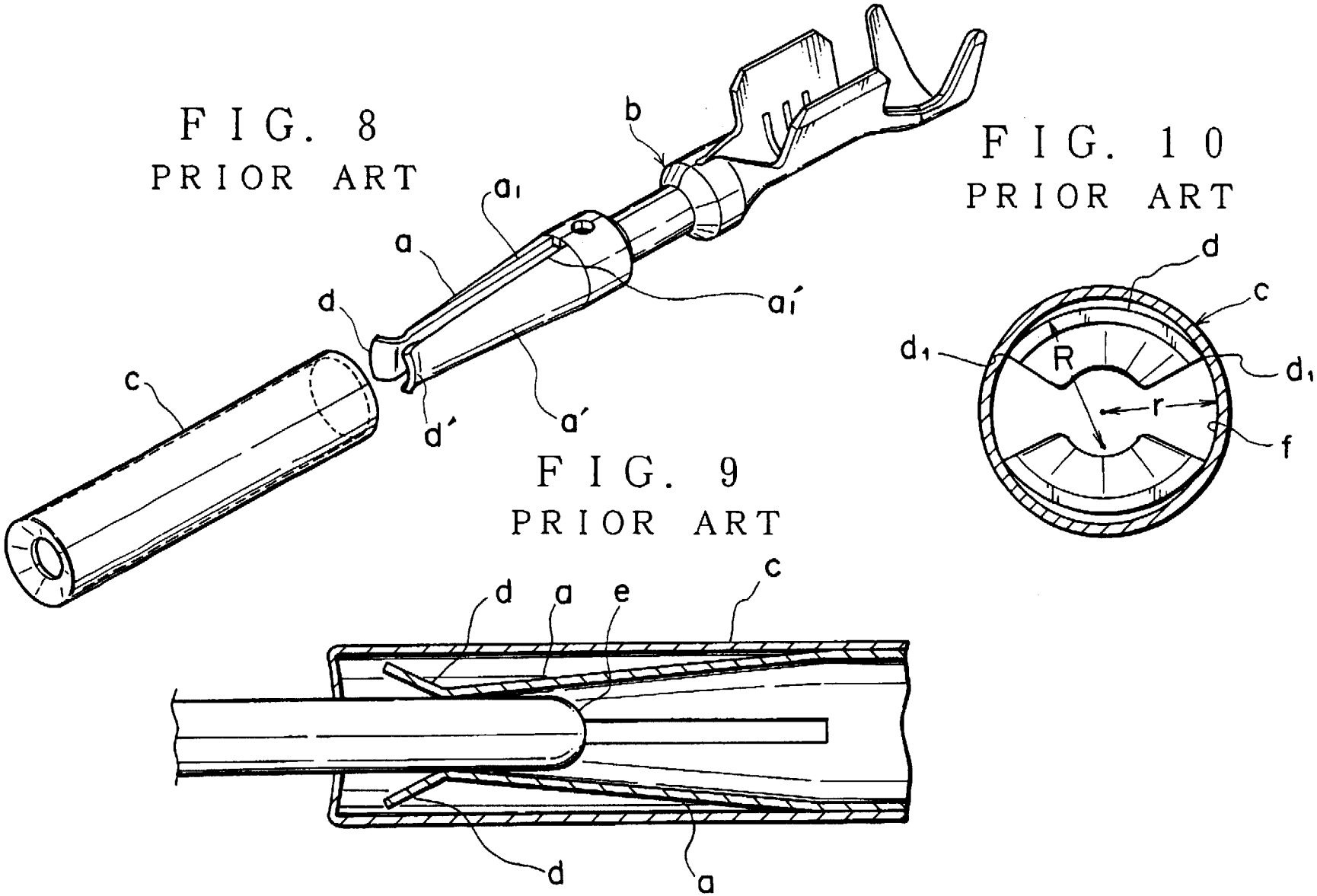
FIG. 10 PRIOR ART
FIG. 8 PRIOR ART
FIG. 9 PRIOR ART
FIG. 8 is an exploded perspective view showing a conventional female terminal.
FIG. 9 is a sectional view showing a male terminal inserted between the elastic clamping portions of FIG. 8.
FIG. 10 is a diagram used to explain the edge portions of the elastic clamping portions abutting the inner wall of the sleeve of FIG. 8.

FIG. 6 illustrates a female terminal B constructed according to still another embodiment of the present invention.

The female terminal B comprises a main body 11 and a sleeve 12 which is inserted onto the main body 11.

The main body 11 of the terminal is formed from a conductive metal plate by a bending process. The main body 11 is equipped with an electric-wire connecting portion 13 with opposed caulking portions 13*a* and also is equipped with an electric contact portion 14 for clamping an opposite male terminal (not shown) which is inserted into the female terminal B. The electric contact portion 14 is provided with a cylindrical proximal portion 14*a* and a pair of opposed elastic clamping portions 14*b* and 14*b*' extending forward from the cylindrical proximal portion 14*a*.

The elastic clamping portions 14*b* and 14*b*' have male-terminal supporting portions 15 and 15' formed so that the spacing therebetween becomes narrower as it goes toward the free ends thereof. The free ends of the male-terminal supporting portions 15 and 15' are bent outwardly to form guiding portions 16 and 16' so that a cooperating male terminal can be readily received. The radius of curvature R of each of the outer peripheral walls 15*a* and 15*a*40 of the supporting portions 15 and 15 is formed so as to become larger than the inner radius of the sleeve 2. In a similar way, the radius of curvature R of each of the outer peripheral walls 16*a* and 16*a*' of the guiding portions 16 and 16 is formed so as to become larger than the inner radius of the sleeve 2.

Inclined surfaces 17 are formed on the opposite edges of the outer peripheral wall 15*a* of the supporting portion 15 and on the opposite edges of the outer peripheral wall 16*a* of the guiding portion 16 by cutting off the corners of the opposite edges. In the same way, inclined surfaces 17' are formed on the opposite edges of the outer peripheral wall 15*a*40 of the supporting portion 15' and the opposite edges of the outer peripheral wall 16*a*' of the guiding portion 16'. Thus, in the female terminal B, the aforementioned inclined surfaces 17 and 17' are formed on the overall opposite edges of the elastic clamping portions 14 and 14*b*'. Therefore, when the male terminal is inserted into the female terminal, there is no possibility that the opposite edges of the elastic clamping portions 14 and 14*b*' are brought into contact with the inner wall of the sleeve 12, even if both the guiding portions 16 and 16' and the supporting portions 15 and 15 of the elastic clamping portions 14*b* and 14*b*' were expanded. Therefore, it becomes possible to enlarge the widths of the elastic clamping portions 14*b* and 14*b*', and clamping force and reliability of device operation can be enhanced.

As has been described above, the female terminal of the present invention is constructed so that an inclined surface is formed on the edge of each elastic clamping portion. Therefore, even if the elastic clamping portions were expanded when an opposite male terminal is inserted into the female terminal, there would be no possibility that the opposite edges of each elastic clamping portion will be brought into contact with the inner wall of the sleeve, and the insertion of the male terminal could be performed easily and smoothly. Since the inclined surfaces have been provided not only on the edges of the guiding portions of the elastic clamping portions but also on the edges of the proximal portions (supporting portions) of the elastic clamping portions, the contact of the elastic clamping portions with the inner wall of the sleeve can be reliably prevented. Therefore, even in the case where the width of the elastic clamping portion is enlarged in order to enhance the clamping force, it becomes possible to suppress an increase in the outer diameter of the terminal and there is the advantage that a reduction in the size of the terminal and a reduction in the weight can be achieved. Moreover, the female terminal of the present invention has the advantage that it can contribute to an enhancement in wiring density.

While the invention has been described with reference to preferred embodiments thereof, the invention is not to be limited to the details given herein, but may be modified within the scope of the appended claims.

What is claimed is:

1. A female terminal comprising:

a main body having a pair of opposed elastic clamping portions;

a cylindrical sleeve into which said main body and pair of opposed elastic clamping portions are inserted; and guiding portions of said elastic clamping portions being formed with an inner peripheral wall surface which is of greater extent than an outer peripheral wall surface thereof, and opposite sides of said inner and outer peripheral wall surfaces being connected by edges whose surfaces inclinedly extend between said inner and outer wall surfaces so that the opposite edges do not contact an inner wall of said sleeve when a male terminal is inserted into the female terminal.

2. The female terminal as set forth in claim 1, wherein inclined surfaces are formed at the intersection of front end portions and the opposite edges of each of the guiding portions of said elastic clamping portions.

3. The female terminal as set forth in claim 1, wherein the outer peripheral walls of the guiding portions of said pair of opposed elastic clamping portions are formed into circular arc shapes and each of the outer peripheral walls has a radius of curvature larger than the inner radius of said sleeve.

4. The female terminal as set forth in claim 2, wherein inclined surfaces are formed at the intersection of front end portions and the opposite edges of each of the guiding portions of said elastic clamping portions.

5. A female terminal comprising:

a main body having a pair of opposed elastic clamping portions;

a cylindrical sleeve into which said main body and pair of opposed elastic clamping portions are inserted; and overall opposite edges of said elastic clamping portions being formed with an inner peripheral wall surface which is of greater extent than an outer peripheral wall surface thereof, and opposite sides of said inner and outer peripheral wall surfaces being connected by edges whose surfaces inclinedly extend between said inner and outer wall surfaces so that the opposite edges do not contact an inner wall of said sleeve, when a male terminal is inserted into the female terminal.

6. The female terminal as set forth in claim 5, wherein the outer peripheral walls of said pair of opposed elastic clamping portions are formed into circular arc shapes and each of the outer peripheral walls has a radius of curvature larger than the inner radius of said sleeve.

* * * * *